US005592783A

United States Patent [19]

Jones

[11] Patent Number: 5,592,783

[45] Date of Patent: Jan. 14, 1997

[54] GUTTER GUARD

[76] Inventor: Lawrence P. Jones, 318 Westminster Ave., Cherry Hill, N.J. 08002

[21] Appl. No.: 488,335

[22] Filed: Jun. 7, 1995

[51] Int. Cl.[6] ..... E04D 13/00

[52] U.S. Cl. ..... 52/12; 52/11; 210/474

[58] Field of Search ..... 52/11, 12, 13, 52/14, 15, 16; 210/474

[56] References Cited

U.S. PATENT DOCUMENTS

| | | | |
|---|---|---|---|
| 471,427 | 3/1892 | Lavallet | 210/474 |
| 2,461,610 | 2/1949 | Lord | 108/28 |
| 3,367,070 | 2/1968 | Mitchell | 52/12 |
| 3,428,183 | 2/1969 | Bristow | 210/474 |
| 4,114,306 | 9/1978 | Molenaar | 46/1 |
| 4,351,134 | 9/1982 | Clarkson | 52/12 |
| 4,644,704 | 2/1987 | Pedgonay | 52/12 |
| 4,841,686 | 6/1989 | Rees | 52/12 |
| 4,907,381 | 3/1990 | Ealer | 52/12 |
| 4,936,061 | 6/1990 | Palma | 52/12 |
| 4,959,932 | 10/1990 | Pfeifer | 52/12 |
| 4,965,969 | 10/1990 | Antenan | 52/12 |
| 5,044,581 | 9/1991 | Dressler | 248/48.1 |
| 5,092,086 | 3/1992 | Rognsvoog, Sr. | 52/12 |
| 5,095,666 | 3/1992 | Williams, Jr. | 52/11 |
| 5,103,601 | 4/1992 | Hunt | 52/12 |
| 5,257,482 | 11/1993 | Sichel | 52/12 |

OTHER PUBLICATIONS

The American Roofer, "Gutter Screen said to Eliminate Drain Problems". Jul. 1949.

*Primary Examiner*—Wynn E. Wood
*Assistant Examiner*—Aimee E. McTigue
*Attorney, Agent, or Firm*—Norman E. Lehrer; Jeffrey S. Ginsberg

[57] ABSTRACT

A gutter guard for preventing the clogging of a gutter includes a spiral member with first and second ends. The spiral member includes a plurality of turns each of which is substantially equal in size and aligned with one another. The spiral member can be moved from a contracted condition to a significantly longer expanded condition. Attached to the top of the spiral member along the length thereof is a mesh screen. The screen has a generally flat appearance when the spiral member is in its expanded condition. A clip secures each of the ends of the spiral member to a corresponding end wall of the gutter.

6 Claims, 2 Drawing Sheets

GUTTER GUARD

BACKGROUND OF THE INVENTION

The present invention is directed toward a device for protecting a roof gutter and, more particularly, to a gutter guard that is readily insertable in a gutter to prevent debris from entering the same.

Presently, there are various known devices that are adapted to cover a rain gutter in order to prevent clogging of the same by twigs, leaves and other debris. Examples of such gutter guards are shown in U.S. Pat. Nos. 2,461,610, 3,367,070, 3,428,183, 4,644,704, 4,841,686, 4,907,381, 4,936,061, 4,959,932, 4,965,969, 5,044,581, 5,095,666, 5,103,601 and 5,257,482. The devices disclosed therein generally consist of some form of screen that is secured over a roof gutter. The screen allows water to pass into the gutter, but prevents the passage of other objects that could potentially clog the gutter.

A problem with each of these devices is that they are not easily installed in the roof gutter. More specifically, some of the devices disclosed include screens which extend over the top of the roof gutter and are secured underneath the roof shingles. Accordingly, the installation of such screen gutter guards is a time consuming and arduous task. Furthermore, replacement of these gutter guards is relatively difficult. This is due to the fact the devices are permanently affixed to the shingles and removal of the former necessarily requires removal of the latter.

Moreover, many of the gutter guards enumerated above are of complicated construction and require the use of a plurality of parts in the installation of the same. The complicated construction also leads to higher manufacturing costs and a more expensive product.

SUMMARY OF THE INVENTION

The present invention is designed to overcome the deficiencies of the prior art discussed above. It is an object of this invention to provide a gutter guard that effectively prevents twigs, leaves, branches and the like from entering and thereby clogging a rain gutter.

It is a further object of the invention to provide such a gutter guard that can be quickly installed in a roof gutter.

It is yet another object of the invention to provide such such a gutter guard that is relatively maintenance free.

In accordance with the illustrative embodiments, demonstrating features and advantages of the present invention, there is provided a gutter guard that includes a coil spring spiral member that is adapted to be positioned in a gutter. The spring member is comprised of a plurality of turns and is expandable so as to occupy the entire axial length of the gutter to be protected. Attached to the top of the spiral member is a mesh screen. More specifically, the screen is welded to several of the turns at equally spaced intervals. The screen is sized to cover the gutter when the spiral member is inserted therein and placed in its expanded condition. The ends of the gutter guard are each clipped to a corresponding end wall of the gutter to secure the gutter in place and to avoid accidental removal.

Other objects, features and advantages will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 3:
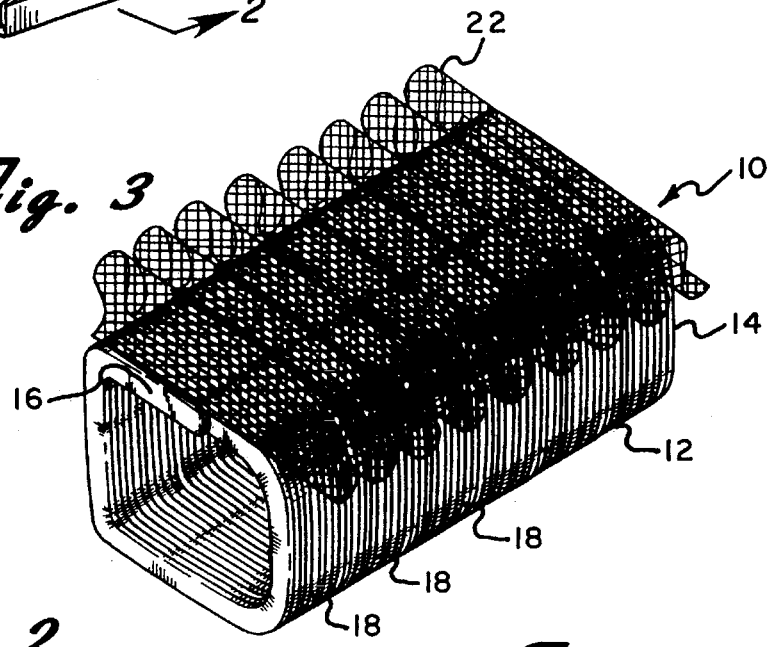
FIG. 3 is a perspective view of the present invention shown in the contracted condition.

Referring now to the drawings in detail wherein like reference numerals have been used throughout the various figures to designate like elements, there is shown in FIG. 3 a gutter guard constructed in accordance with the principles of the present invention and designated generally as 10.

Figure 2:
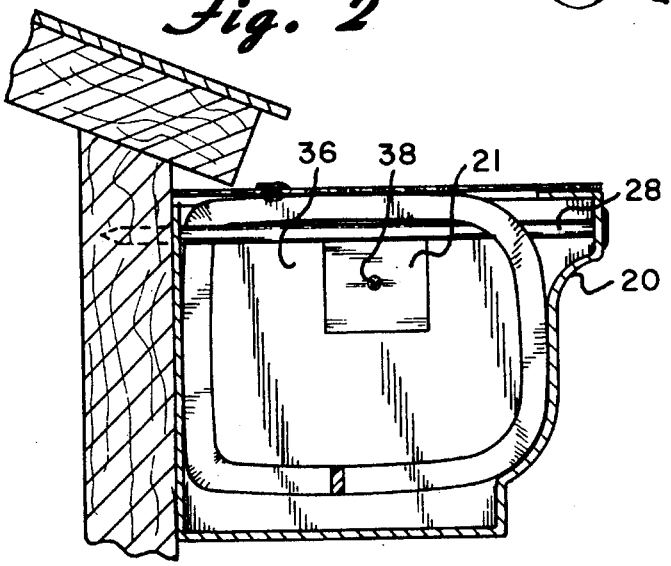
FIG. 2 is a cross-sectional view taken along lines 2—2 of FIG. 1.
Figure 4:
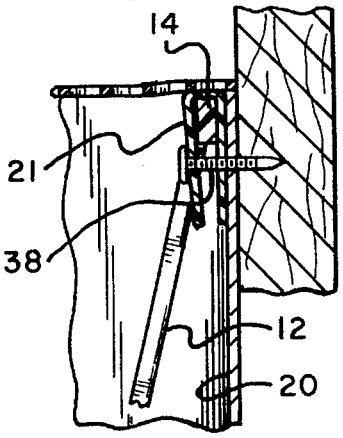
FIG. 4 is a cross-sectional view showing the end of the gutter guard clipped to a gutter.

The gutter guard 10 includes a continuous flexible coil spring spiral member 12 that has a first end 14 and a second end 16. The spiral member has a substantially rectangular transverse cross-section and includes a plurality of turns 18 that are equal in size when in the contracted condition (see FIG. 2 and 3). The number of turns determines the length of the spiral member. A preferred material for the member 12 is a rigid plastic, such as polyethylene, so that it can withstand the elements and is not easily susceptible to permanent deformation. However, it can be made of a variety of other materials. The spiral member 12 can be made, for example, similar to the structure shown in U.S. Pat. No. 4,114,306.

Figure 5:
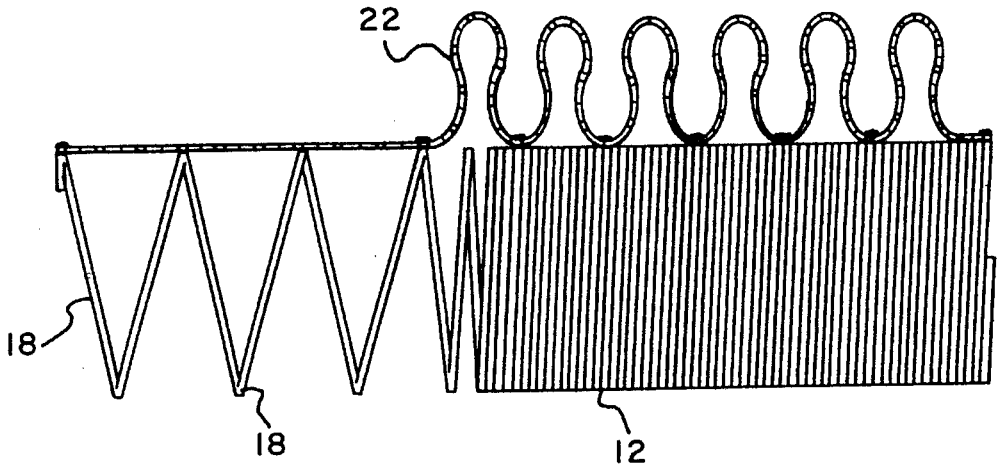
FIG. 5 is a side view of the gutter guard shown in a partially expanded condition.
Figure 6:
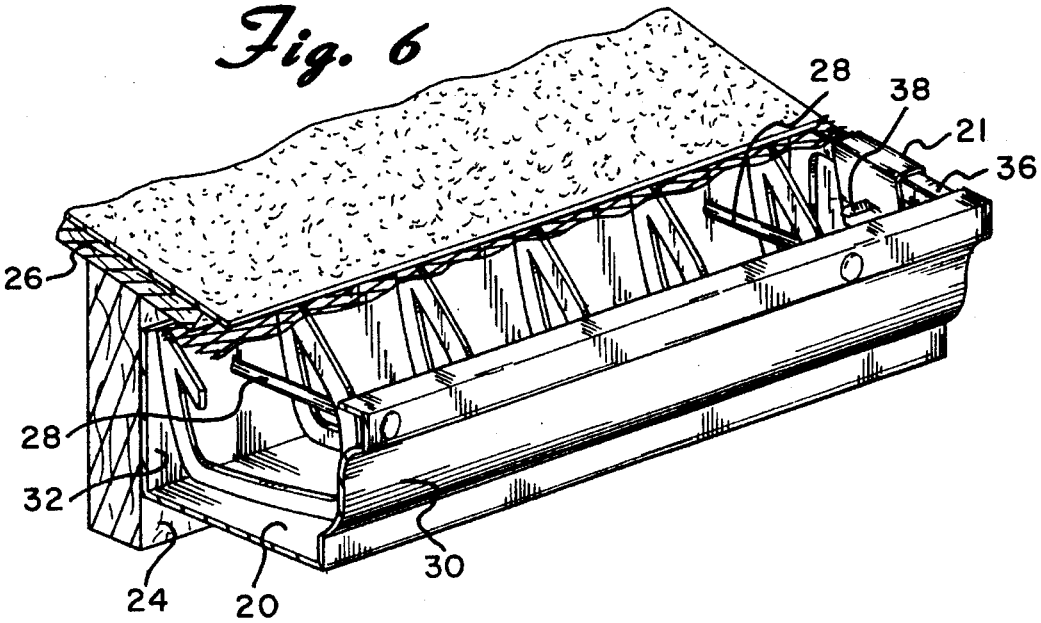
FIG. 6 is a partial perspective view of the gutter guard with a portion of the screen cut away for illustration purposes.

The spiral member 12 is readily expandable along a longitudinal axis. As the member is stretched, the adjacent turns 18 are spread apart as illustrated in FIG. 5. The spiral member in its expanded condition has a substantially greater axial length than in its contracted condition. In use, the member 12 is stretched so that its axial length can occupy the axial length of a gutter 20 it is to be inserted into. The ends 14 and 16 of the spiral member 12 are secured to the gutter 20 by means of U-shaped end clips 21 as more fully described below.

A mesh screen 22 is secured to the top of the spiral member 12 by welding the same to selected turns 18. It should be noted that the screen can be attached to the top of the spiral member in other ways such as by gluing the same thereto. The screen is preferably made of a relatively thin compressible plastic. When the spiral member 12 is in its contracted position, the screen is similarly compressed together as illustrated in FIG. 3. However, when the spiral member is expanded, the mesh screen 22 is substantially planar (see FIGS. 1 and 5).

Referring to FIGS. 1, 2, 4 and 6, a gutter 20 is shown. The gutter 20 is typically secured along the upper portion of a wall 24, which extends below the edge of a roof 26, by means of a plurality of elongated nails 28. More specifically, the nails are inserted through the front and rear walls 30 and 32, respectively, of the gutter 20 and into the wall 24.

To facilitate an understanding of the principles associated with the foregoing apparatus, its operation will now be briefly described. The first end 14 of the spring member 12 is placed in the gutter 20. The end 14 is then secured to an end wall 36 of the gutter 20 by U-shaped end clip 21. More specifically, clip 21 is fit over an end wall 36 of the gutter 20 and over the first end 14 of the spiral member 12. A nail or screw 38 is then inserted through the end wall 36 and through the U-shaped end clip 21 in order to secure the first end 14 of the gutter guard 10 to the gutter 20 as illustrated in FIGS. 1, 2, 4 and 6.

Thereafter, the spiral member 12 is stretched so that adjacent turns 18 are spaced from one another. The space allows the spiral member to be positioned over the nails 28 (see FIGS. 1 and 6). Moreover, the spiral member can readily be maneuvered around the nails so as not to interfere with the insertion since the spiral member is flexible. The shape of the individual turns is substantially equivalent to the shape of a cross-section of the gutter so that the spiral member can be securely positioned in the gutter.

Figure 1:
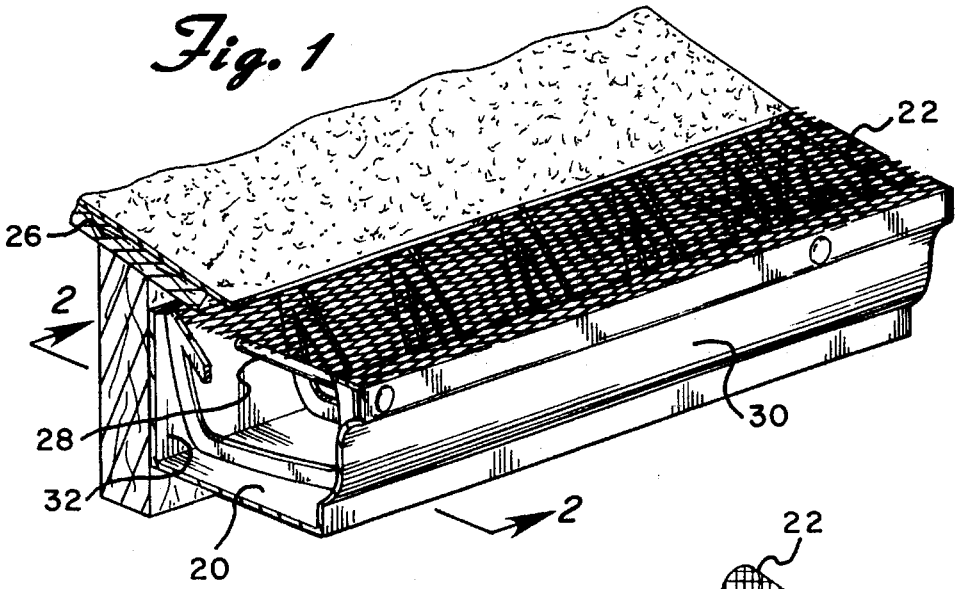
FIG. 1 is a partial perspective view of the gutter guard of the present invention shown installed in a roof gutter.

Referring to FIG. 1, as the spiral member 12 is expanded and positioned in the gutter 20 in order to occupy the entire length of the same, the screen is similarly stretched until it has a substantially flat appearance. The screen is designed to completely cover the open top end of the gutter 20 when the gutter guard 10 is in place.

Thereafter, the second end 16 of the spiral member 12 is secured in the gutter 20 by utilizing another U-shaped end clip 21 which is secured to an opposing end wall 36 of the gutter 20. Once again, this is accomplished by fitting a clip 21 over end wall 36 and over end 16 of the spiral member 12. A nail or screw is then inserted through the end wall 36 and through the U-shaped end clip 21 in order to permanently secure the gutter guard 10 in the gutter 20. Accordingly, the clips 21 are utilized to prevent accidental removal of the gutter guard from the gutter caused by high winds, heavy precipitation or the like. To further secure the gutter guard 10 in place, additional clips can be placed through the mesh screen 22 and around individual turns of the spiral member 12 and around individual nails 28. Once in place, the screen 22 prevents any leaves, twigs, branches or the like from entering the gutter and thereby clogging the same.

Figure 7:
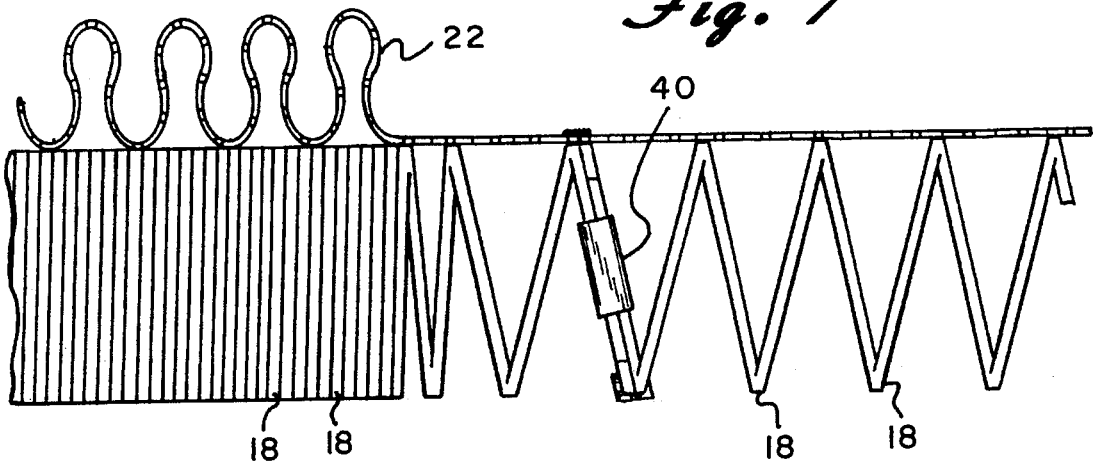
FIG. 7 is a side view of two gutter guards shown clipped together.

Referring to FIG. 7, a pair of gutter guards are shown joined together by means of a clip 40. The gutter guards are substantially equivalent to one another. Two (or more) gutter guards can be attached to one another when the gutter to be protected is sufficiently long so as to require added length. The combined gutter guards are inserted and secured in and along the gutter in the same manner as described above.

The present invention may be embodied in other specific forms without departing from the spirit or essential attributes thereof and accordingly reference should be made to the appended claims rather than to the foregoing specification as indicating the scope of the invention.

What is claimed is:

1. In combination with a gutter having a front wall, a rear wall, a bottom wall and a predetermined axial length; a gutter guard for preventing the clogging of said gutter comprising:

a coil spring spiral member having a top, a bottom, first and second ends, and including a plurality of turns, each of said turns being substantially equal in size and being aligned with one another, said spiral member being adapted for movement between a contracted condition and an expanded condition, and a mesh screen attached to the top of said spiral member along the length thereof, said mesh screen being substantially planar when said spiral member is in its expanded condition.

2. The gutter guard of claim 1 further including fastening means for securing said gutter guard to the gutter.

3. The gutter guard of claim 1 wherein each of said turns of said spiral member has a substantially rectangular cross-section for allowing said spiral member to be securely positioned in the gutter.

4. The gutter guard of claim 2 wherein said fastening means includes a first clip and a second clip, said first clip being adapted to secure said first end of said spiral member to an end of the gutter and said second clip being adapted to secure said second end of said spiral member to an opposing end of the gutter.

5. The gutter guard of claim 1 wherein said spiral member and said mesh screen are comprised of plastic.

6. The gutter guard of claim 1 wherein said spiral member has an axial length substantially equivalent to the axial length of the gutter when said spiral member is in its expanded condition.

* * * * *